US011029058B2

(12) United States Patent
Kono et al.

(10) Patent No.: US 11,029,058 B2
(45) Date of Patent: Jun. 8, 2021

(54) AIR CONDITIONER

(71) Applicant: Mitsubishi Electric Corporation, Tokyo (JP)

(72) Inventors: Atsushi Kono, Tokyo (JP); Takashi Ikeda, Tokyo (JP); Masahiko Takagi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/075,700

(22) PCT Filed: Apr. 27, 2016

(86) PCT No.: PCT/JP2016/063257
§ 371 (c)(1),
(2) Date: Aug. 6, 2018

(87) PCT Pub. No.: WO2017/187570
PCT Pub. Date: Nov. 2, 2017

(65) Prior Publication Data

US 2019/0041085 A1 Feb. 7, 2019

(51) Int. Cl.

| | |
|---|---|
| ***F24F 11/79*** | (2018.01) |
| ***F24F 13/14*** | (2006.01) |
| ***F24F 7/10*** | (2006.01) |
| *F24F 1/0047* | (2019.01) |
| *F24F 13/15* | (2006.01) |
| *F24F 1/0011* | (2019.01) |

(52) U.S. Cl.
CPC ..... *F24F 13/1406* (2013.01); *F24F 7/10* (2013.01); *F24F 13/14* (2013.01); *F24F 13/1413* (2013.01); *F24F 1/0011* (2013.01); *F24F 1/0047* (2019.02); *F24F 11/79* (2018.01); *F24F 13/1486* (2013.01); *F24F 13/15* (2013.01)

(58) Field of Classification Search
CPC ..... F24F 13/1406; F24F 13/1413; F24F 7/10
See application file for complete search history.

(56) References Cited

U.S. PATENT DOCUMENTS

2014/0367069 A1 12/2014 Yamaguchi et al.
2018/0345761 A1* 12/2018 Kaneda ..... F24F 13/1413

FOREIGN PATENT DOCUMENTS

CN 1295222 A 5/2001
CN 104136854 A 11/2014
EP 1 152 193 A1 7/2001
(Continued)

OTHER PUBLICATIONS

Yasuyuki, Ceiling embedded type Air Conditioner, Nov. 2001, Full Document (Year: 2001).*
(Continued)

*Primary Examiner* — Elizabeth J Martin
*Assistant Examiner* — Nael N Babaa
(74) *Attorney, Agent, or Firm* — Posz Law Group, PLC

(57) ABSTRACT

An air conditioner has a casing and a wind direction changing device. The casing has an air inlet, an air outlet, an outer air path wall, and an inner air path wall. The wind direction changing device has an up-down rotation shaft and a deflector. The deflector extends from the up-down rotation shaft toward the outer air path wall. The deflector has an outer air path wall-side end which faces the outer air path wall and has a first arc shape.

6 Claims, 6 Drawing Sheets

(56) References Cited

FOREIGN PATENT DOCUMENTS

| | | | | | |
|---|---|---|---|---|---|
| EP | 1152193 | A1 | * | 11/2001 | ..... F24F 1/0011 |
| EP | 2 327 938 | A1 | | 6/2011 | |
| JP | S60-101442 | A | | 6/1985 | |
| JP | S61-54120 | U | | 4/1986 | |
| JP | U03-37354 | U | * | 8/1989 | ..... F24F 13/15 |
| JP | H03-37354 | U | | 4/1991 | |
| JP | H03-103955 | U | | 10/1991 | |
| JP | H03-129850 | U | | 12/1991 | |
| JP | H04-18248 | U | | 2/1992 | |
| JP | H06-147627 | A | | 5/1994 | |
| JP | H07-174403 | A | | 7/1995 | |
| JP | H07174403 | A1 | * | 7/1995 | ..... F24F 13/15 |
| JP | 2001-132976 | | | 5/2001 | |
| JP | 2001-280684 | A | | 10/2001 | |
| JP | 2008-025880 | A | | 2/2008 | |
| JP | 2013/129123 | A1 | | 9/2013 | |
| JP | 2016-020797 | A | | 2/2016 | |
| WO | 2013/129123 | A1 | | 9/2013 | |

OTHER PUBLICATIONS

Taichi, Air Conditioner, Jul. 1995, Full Document (Year: 1995).*
Office Action dated Jul. 2, 2019 issued in corresponding JP patent application No. 2018-514031 (and English machine translation).
International Search Report of the International Searching Authority dated Jul. 26, 2016 for the corresponding international application No. PCT/JP2016/063257 (and English translation).
Extended European Search Report dated Mar. 13, 2019 issued in corresponding EP patent application No. 16900442.1.
Office Action dated Feb. 25, 2020 issued in corresponding CN patent application No. 2016800838961 (and English translation).

* cited by examiner

AIR CONDITIONER

CROSS REFERENCE TO RELATED APPLICATION

This application is a U.S. national stage application of International Application PCT/JP2016/063257, filed on Apr. 27, 2016, the contents of which are incorporated herein by reference.

TECHNICAL FIELD

The present invention relates to an air conditioner.

BACKGROUND

As a conventional example of the air conditioner, a ceiling-embedded-type air conditioner is used. The ceiling-embedded-type air conditioner has an air outlet along the peripheral edge of a front panel. In the air outlet, an up-down deflector is disposed. The up-down deflector allows air with adjusted temperature and humidity to be discharged in the direction orthogonal to the peripheral edge of the front panel. The air, however, is not discharged in the left-right direction of the air outlet disposed along the peripheral edge of the front panel, possibly resulting in uneven temperature and thus reduced comfort in a space to be air-conditioned.

In this regard, a conventional ceiling-embedded-type air conditioner is disclosed for example in Japanese Patent Laying-Open No. 2001-280684 (PTL 1). This air conditioner has left-right deflectors on an up-down deflector disposed in an air outlet. The up-down deflector and the left-right deflectors allow air to be discharged into a space not only in the orthogonal direction but also in the left-right direction so as to eliminate uneven temperature.

PATENT LITERATURE

PTL 1: Japanese Patent Laying-Open No. 2001-280684

For the air conditioner disclosed in the above-referenced publication, it is necessary to have an adequate space between an end of the left-right deflector and a wall surface of an outlet air path so as not to cause contact, while the up-down deflector is rotated in the up-down direction, between the wall surface of the outlet air path and the left-right deflector disposed on the up-down deflector. A resultant problem is leakage of airflow through the space between the end of the left-right deflector and the wall surface of the outlet air path.

SUMMARY

The present invention has been made in view of the problem above, and an object of the invention is to provide an air conditioner capable of suppressing leakage of airflow.

An air conditioner of the present invention has a casing and a wind direction changing device. The casing has an air inlet, an air outlet, a first flow path wall, and a second flow path wall. The air outlet has a first side and a second side. The second side extends along the first side and is located closer to the air inlet than the first side. The wind direction changing device is disposed between the first flow path wall and the second flow path wall of the casing. The wind direction changing device has a shaft and a deflector. The shaft extends in a direction along the second side. The deflector is connected to the shaft and configured to rotate about the shaft. The deflector extends from the shaft toward the first flow path wall. The deflector has a first end which faces the first flow path wall and has a first arc shape.

Regarding the air conditioner of the present invention, the first end facing the first flow path wall has the first arc shape. Therefore, while the deflector is rotated about the center, the space between the first flow path wall and the first end can be kept constant. Accordingly, leakage of airflow from the space between the first flow path wall and the first end can be suppressed.

DETAILED DESCRIPTION

Figure 1:
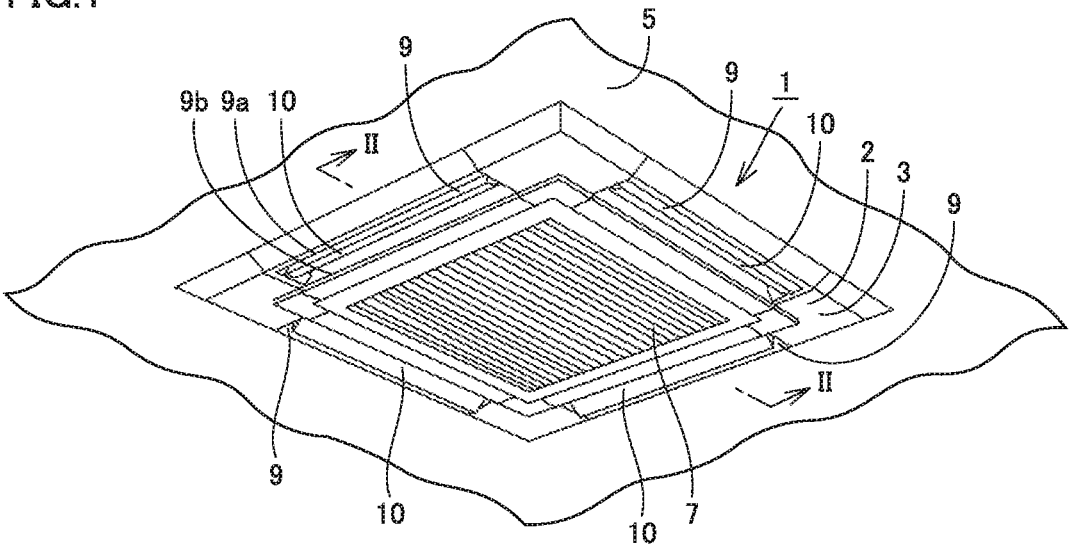
FIG. 1 is a perspective view schematically showing an air conditioner in a first embodiment of the present invention in a state of being installed in a ceiling.

Embodiments of the present invention are described below based on the drawings. In the drawings, the same reference characters denote the same or corresponding parts.

First Embodiment

Referring to FIGS. 1 to 4, a configuration of an air conditioner 1 in a first embodiment of the present invention is described. Air conditioner 1 in the first embodiment is an indoor unit of a so-called packaged air conditioner. Air conditioner 1 in the first embodiment is an indoor unit of a so-called ceiling-embedded-type air conditioner.

Figure 2:
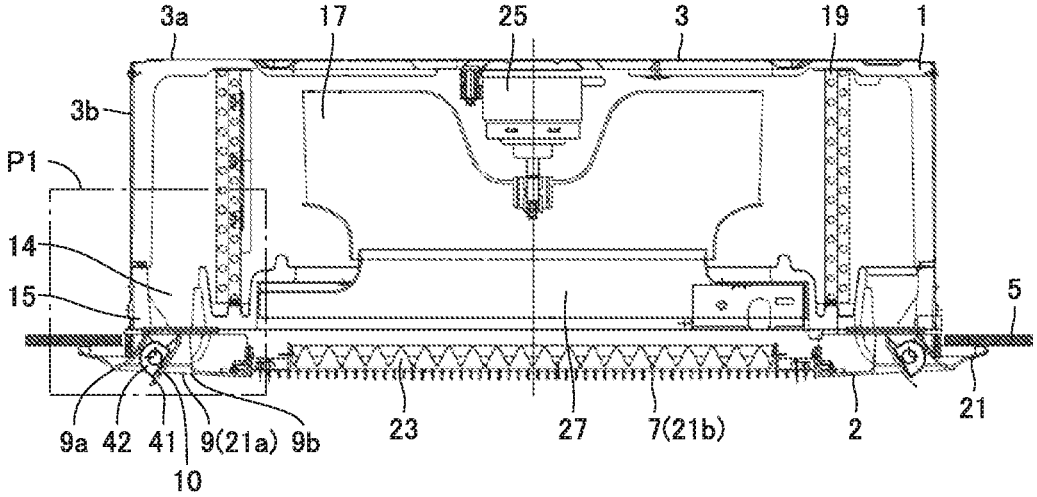
FIG. 2 is a cross-sectional view along line II-II in FIG. 1.
Figure 3:
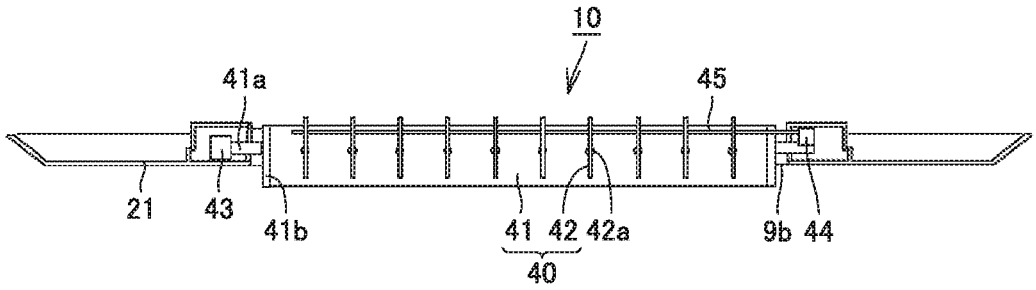
FIG. 3 is a front view schematically showing a peripheral configuration of a wind direction changing device of the air conditioner in the first embodiment of the present invention.
Figure 4:
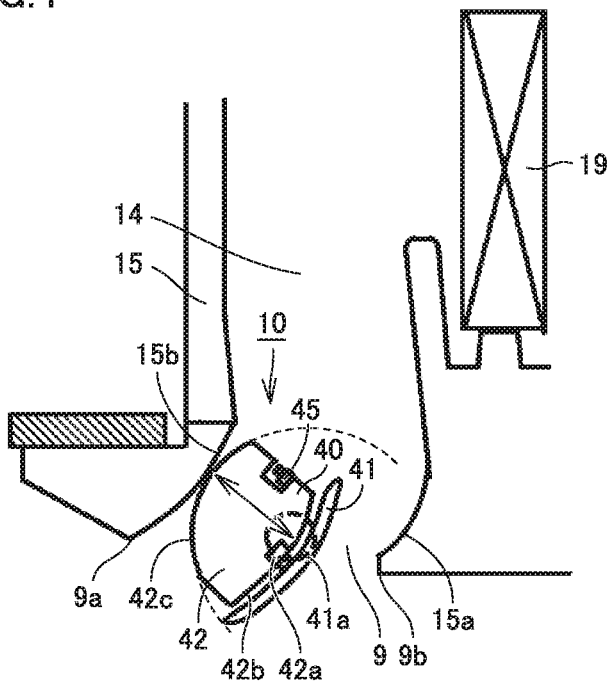
FIG. 4 is a schematic diagram showing a portion P1 in FIG. 2 in an enlarged form.

FIG. 1 shows, from below, air conditioner 1 in the first embodiment, in the state of being installed in a ceiling 5. FIG. 2 laterally shows an internal structure of air conditioner 1 in the first embodiment. FIG. 2 illustrates a condition that most of a case 3 of air conditioner 1 is embedded in the back side of ceiling 5 (the side opposite to a room), and a lower portion of case 3 faces the inside of the room. For the sake of visibility, the cross section is not hatched with oblique lines in FIG. 2. FIG. 3 shows, from the front side, an internal structure of a peripheral region of a wind direction changing device 10 in the first embodiment. FIG. 4 shows a vertical cross section of one air outlet 9 and its peripheral region in the air conditioner in the first embodiment. In FIG. 4, the cross section except for ceiling 5 is not hatched with oblique lines. The same applies to FIGS. 5 to 11.

Referring to FIGS. 1 and 2, air conditioner 1 in the present embodiment mainly includes a casing 2, a wind direction changing device 10, a centrifugal fan 17, a heat exchanger 19, a filter 23, a fan motor 25, and a bell mouth 27. Casing 2 has a case 3 and a panel 21. Casing 2 has at least one air inlet 7 and at least one air outlet 9. At least one air inlet 7 and at least one air outlet 9 are disposed in a lower portion of casing 2. Air conditioner 1 in the present embodiment has, by way of example, one air inlet 7 and four air outlets 9 in the lower portion of casing 2. Air outlets 9 are each formed in a rectangular shape as seen in plan view. Air outlet 9 has a first side 9*a* and a second side 9*b*. First side 9*a* extends along one side of air inlet 7. Second side 9*b* extends along first side 9*a*. Second side 9*b* is disposed in parallel with first side 9*a*. Second side 9*b* is located closer to air inlet 7 than first side 9*a* is.

Further, case 3 has a wall 15 defining an outlet air path 14 having air outlet 9 as its outlet. In air outlet 9, wind direction changing device 10 is disposed. Wind direction changing device 10 has an up-down deflector 41 distributing airflow from air outlet 9 in the up-down direction, and a left-right deflector 42 distributing airflow from air outlet 9 in the left-right direction.

Case 3 contains centrifugal fan 17 functioning as a blower which generates a flow of air taken from air inlet 7 into case 3 and discharged from air outlet 9 into a space to be air-conditioned (room), and a heat exchanger 19 disposed in such an air flow path.

By way of example, case 3 in the first embodiment has a top plate 3*a* in a rectangular shape as seen in plan view, and four side plates 3*b* extending downward from the four sides of top plate 3*a*. In other words, case 3 is a box in the shape of a rectangular shell formed of four side plates 3*b* and top plate 3*a* closing the top face of the rectangular shell. At the bottom of case 3, i.e., an open bottom face of the box, a panel 21 is attached detachably to case 3. Panel 21 is a design panel (decorative panel).

A grill-type panel air inlet 21*b* is disposed in a substantially central region of panel 21. A filter 23 removing dust from air passing through a grill portion of panel air inlet 21*b* is disposed downstream (at the top) of panel air inlet 21*b*. By way of example, each of panel 21 and panel air inlet 21*b* in the first embodiment has an outer edge in a rectangular shape as seen in plan view.

In the region between the outer edge of panel 21 and the outer edge of panel air inlet 21*b*, four panel air outlets 21*a* are disposed. In the first embodiment, as each of panel 21 and panel air inlet 21*b* has edges along the four sides, four panel air outlets 21*a* are disposed. Each of four panel air outlets 21*a* is arranged along a corresponding side of panel 21 and panel air inlet 21*b*, except for the corners of panel 21. Four panel air outlets 21*a* are located to surround panel air inlet 21*b*.

In the first embodiment, panel air inlet 21*b* is aforementioned air inlet 7, and four panel air outlets 21*a* are aforementioned four air outlets 9. Panel air outlet 21*a* (air outlet 9) and outlet air path 14 extend along a corresponding side of panel 21 and panel air inlet 21*b*, except for the corners of panel 21. The direction in which they extend is defined herein as longitudinal direction and the direction orthogonal to the longitudinal direction is defined herein as lateral direction, as seen in plan view. By way of example, regarding panel air outlets 21*a* (air outlet 9) and outlet air paths 14 shown in FIG. 2, the left-right direction of the drawing in FIG. 2 is the lateral direction and the direction of the depth extending backward from the drawing in FIG. 2 is the longitudinal direction.

In a central region within case 3, fan motor 25 is disposed. Fan motor 25 is supported on the lower surface of top plate 3*a* of case 3 (on the inner space side of case 3). Centrifugal fan 17 is attached to a rotation shaft, which extends downward, of fan motor 25. Further, between centrifugal fan 17 and filter 23, bell mouth 27 is disposed to form an air inlet flow path extending from panel air inlet 21*b* toward centrifugal fan 17. Centrifugal fan 17 sucks air from panel air inlet 21*b* into case 3, and discharges the air from panel air outlet 21*a* into the room which is a space to be air-conditioned.

Heat exchanger 19 is disposed radially outward of centrifugal fan 17. In other words, heat exchanger 19 is disposed in an air flow path generated in case 3 by centrifugal fan 17 to exchange heat between air and refrigerant.

Heat exchanger 19 has a plurality of fins arranged at predetermined intervals in the horizontal direction, and a heat transfer tube extending through these fins. The heat transfer tube is connected to a well-known outdoor unit (not shown) by a connection tube. Thus, cooled refrigerant or heated refrigerant is supplied to heat exchanger 19. The configuration and/or the form of centrifugal fan 17, bell mouth 27, and heat exchanger 19 is not particularly limited, and those used for the first embodiment are well-known ones.

In such a configuration, rotation of centrifugal fan 17 causes indoor air to be sucked into panel air inlet 21*b* (air inlet 7) of panel 21. The air from which dust is removed by filter 23 is guided by bell mouth 27 to be sucked into centrifugal fan 17. The air sucked upward into centrifugal fan 17 is discharged horizontally and radially outward. While the discharged air is passed through heat exchanger 19, heat is exchanged with the air and the humidity of the air is adjusted. After this, the direction of flow of the air is changed to the downward direction and the air is discharged from each of four panel air outlets 21*a* (air outlets 9) into the room.

Next, referring to FIGS. 3 and 4, a peripheral configuration of panel air outlet 21*a* is described in detail.

Wall 15 defining outlet air path 14 with its outlet located at air outlet 9 has an inner air path wall 15*a* and an outer air path wall 15*b*. Namely, case 3 of casing 2 has inner air path wall 15*a* and outer air path wall 15*b*. In the present embodiment, outer air path wall 15*b* is a first flow path wall, and inner air path wall 15*a* is a second flow path wall. Outer air path wall 15*b* is connected to first side 9*a* of air outlet 9. Inner air path wall 15*a* is connected to second side 9*b* of air outlet 9.

Inner air path wall 15*a* faces outer air path wall 15*b* with air outlet 9 located therebetween. Inner air path wall 15*a* is located on the inner side of wall 15 and outer air path wall 15*b* is located on the outer side of wall 15. Specifically, inner air path wall 15*a* is located on the heat exchanger 19 side. Outer air path wall 15*b* is located on the panel 21's peripheral edge side. Namely, inner air path wall 15*a* is disposed on air inlet 7 side located at a center. Outer air path wall 15*b* is disposed opposite to air inlet 7 with respect to inner air path wall 15*a*.

Wind direction changing device 10 is disposed between inner air path wall 15*a* and outer air path wall 15*b*. Wind direction changing device 10 mainly has an up-down rotation shaft (shaft) 41*a* and a deflector 40. Up-down rotation shaft 41*a* extends in the direction along second side 9*b* of air outlet 9. Up-down rotation shaft 41*a* extends in a direction crossing the direction in which inner air path wall 15*a* is opposite to outer air path wall 15*b*. In other words, up-down rotation shaft 41*a* extends in the longitudinal direction of air outlet 9.

Deflector 40 is connected to up-down rotation shaft 41*a* and rotates about up-down rotation shaft (shaft) 41*a*. Deflector 40 extends from up-down rotation shaft 41*a* toward outer air path wall 15*b*. Deflector 40 has an up-down deflector 41 and a left-right deflector 42. Up-down deflector 41 is configured to distribute airflow from air outlet 9 in the up-down direction. Left-right deflector 42 is disposed on up-down deflector 41. Left-right deflector 42 is configured to distribute airflow from air outlet 9 in the left-right direction (direction of the rotation shaft of up-down deflector 41).

Left-right deflector 42 has an up-down deflector-side end 42*b* facing up-down deflector 41, and an outer air path wall-side end (first end) 42*c* facing outer air path wall 15*b*. Namely, left-right deflector 42 has outer air path wall-side end 42*c* located opposite to up-down deflector 41.

Outer air path wall-side end 42*c* has a curved shape bulging toward outer air path wall 15*b* as seen from up-down rotation shaft 41*a*. In the present embodiment, the curved shape is an arc shape (first arc shape).

The center of up-down rotation shaft (shaft) 41*a* coincides with the center of curvature of the first arc shape of outer air path wall-side end 42*c*. Therefore, the distance between the center of up-down rotation shaft 41*a* and the outer peripheral end of the first arc shape of outer air path wall-side end 42*c* is constant. Thus, because the curved shape of outer air path wall-side end 42*c* is an arc shape centered at up-down rotation shaft 41*a*, the space between outer air path wall-side end 42*c* and outer air path wall 15*b* keeps a constant distance therebetween, regardless of the position to which up-down deflector 41 is driven in the range of wind direction control in the up-down direction.

The constant distance herein includes not only an exactly constant distance but also a substantially constant distance. In other words, this constant distance may be any of distances falling within a range that produces an equivalent effect on suppressing leakage of airflow. The shortest distance between outer air path wall-side end 42*c* and outer air path wall 15*b* as seen from up-down rotation shaft 41*a* is preferably 10% or less of the distance between up-down deflector 41 and outer air path wall 15*b*.

Deflector 40 has at least one up-down deflector 41 and at least one left-right deflector 42. In the present embodiment, wind direction changing device 10 has one up-down deflector 41 and a plurality of left-right deflectors 42. A plurality of left-right deflectors 42 are arranged in parallel with each other.

Up-down rotation shaft 41*a* and a deflector side plate 41*b* are connected to up-down deflector 41. Up-down rotation shaft 41*a* and deflector side plate 41*b* are disposed at each of the opposite ends, in the lateral direction, of up-down deflector 41. Up-down rotation shaft 41*a* supports up-down deflector 41 in such a manner that enables up-down deflector 41 to rotate in the up-down direction. Deflector side plate 41*b* connects up-down rotation shaft 41*a* to up-down deflector 41. Up-down rotation shaft 41*a* is rotatably connected to an up-down driving motor 43. Up-down driving motor 43 is fixed to panel 21. Driving power of up-down driving motor 43 rotates up-down rotation shaft 41*a* in the up-down direction to cause up-down deflector 41 to rotate in the up-down direction about up-down rotation shaft 41*a*.

Each of a plurality of left-right deflectors 42 has a left-right rotation shaft 42*a*. Left-right rotation shaft 42*a* is supported on up-down deflector 41 in such a manner that enables left-right deflector 42 to rotate in the left-right direction. These left-right deflectors 42 are each connected to a coupling plate 45. Coupling plate 45 extends through respective rear ends of these left-right deflectors 42. These left-right deflectors 42 are each connected to a left-right deflector motor 44 through coupling plate 45 and a driving mechanism Left-right deflector motor 44 is fixed to wind direction changing device 10. Driving power of left-right deflector motor 44 moves coupling plate 45 in the left-right direction and thereby rotates left-right deflector 42 in the left-right direction about left-right rotation shaft 42*a*. Coupling plate 45 may be a single coupling plate 45 driving all the left-right deflectors 42. Alternatively, coupling plate 45 may divided, at the center in the left-right direction, into two coupling plates 45 each driving left-right deflector 42.

Next, functions and effects of air conditioner 1 in the first embodiment are described.

Regarding air conditioner 1 in the first embodiment, outer air path wall-side end (first end) 42*c* facing outer air path wall (first flow path wall) 15*b* has a first arc shape. It is therefore possible, while deflector 40 is rotating about up-down rotation shaft 41*a*, to keep constant the space between outer air path wall 15*b* and outer air path wall-side end 42*c*. Accordingly, leakage of airflow from the space between outer air path wall 15*b* and outer air path wall-side end 42*c* can be suppressed.

Regarding air conditioner 1 in the first embodiment, the center of up-down rotation shaft (shaft) 41*a* coincides with the center of curvature of the first arc shape of outer air path wall-side end 42*c*. Therefore, the distance between the center of up-down rotation shaft 41*a* and the outer end of the first arc shape of outer air path wall-side end 42*c* can be made constant. Accordingly, while deflector 40 is rotating about up-down rotation shaft 41*a*, the space between outer air path wall 15*b* and outer air path wall-side end 42*c* can be kept constant.

Regarding air conditioner 1 in the first embodiment, left-right deflector 42 disposed on up-down deflector 41 has outer air path wall-side end (first end) 42*c* located opposite to up-down deflector 41. Thus, left-right deflectors 42 partition the air path between up-down deflector 41 and outer air path wall 15*b* in the left-right direction (the direction of the rotation shaft of up-down deflector 41). Leakage of airflow from the space between outer air path wall 15*b* and outer air path wall-side end 42*c* of left-right deflector 42 can be suppressed, and therefore, reduction of the force exerted in the left-right direction on the air can be suppressed. Accordingly, the outgoing airflow can be distributed in the left-right direction across a sufficient range. Uneven temperature in a space to be air-conditioned can therefore be suppressed. Further, because air can be moved in the left-right direction so as not to impinge directly against a user, discomfort due to the impinging air can be alleviated. Improved comfort can be achieved in this way.

Moreover, because separation of airflow due to leakage of airflow from left-right deflector 42 can be suppressed, loss is suppressed and accordingly reduction of efficiency can be suppressed. In the case of the ceiling-embedded-type air conditioner, because the air outlet and the air inlet are close to each other, hot and moist indoor air flowing toward the air inlet during a cooling operation is likely to be cooled at the air outlet, resulting in condensation. It is possible, because airflow separation is suppressed, to prevent hot and moist indoor air from being drawn into a vortex of separated air and thereby prevent resultant condensation.

Second Embodiment

Figure 5:
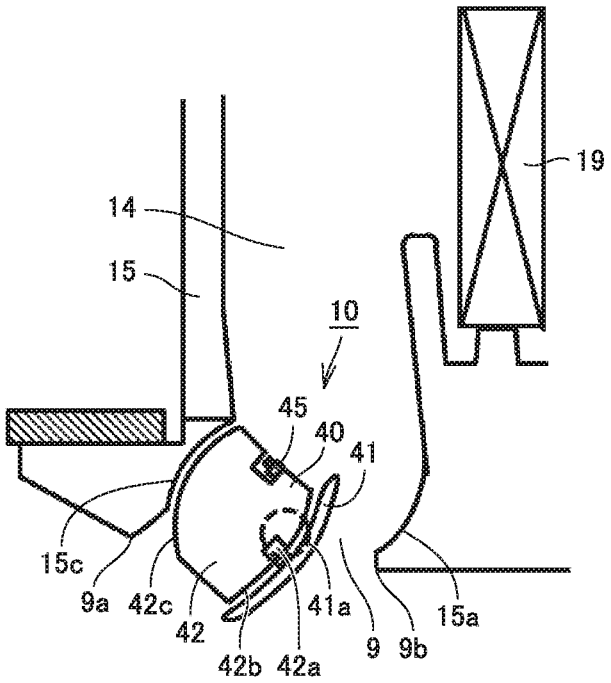
FIG. 5 is a schematic diagram showing a portion, which corresponds to the portion in FIG. 4, of an air conditioner in a second embodiment of the present invention.

Next, referring to FIG. 5, an air conditioner in a second embodiment of the present invention is described. The second embodiment is similar to the above-described first embodiment except for the below-described features or limitations. FIG. 5 is a diagram similar to FIG. 4 relating to the first embodiment.

In the second embodiment, outer air path wall 15*b* has a curved outer air path wall surface 15*c* at a position where outer air path wall 15*b* faces left-right deflector 42. Specifically, curved outer air path wall surface (first flow path wall) 15*c* has an arc shape (second arc shape) which is depressed along a circle of curvature centered at up-down rotation shaft 41*a*.

Curved outer air path wall surface 15*c* is a cylindrical surface concentric with the arc of outer air path wall-side end 42*c* of left-right deflector 42. Specifically, the arc shape (second arc shape) of curved outer air path wall surface 15*c* is located concentrically with the arc shape (first arc shape) of outer air path wall-side end 42*c*. The "concentric" condition herein includes not only an exactly concentric condition but also a substantially concentric condition. In other words, this concentric condition may be any of concentric conditions within a range that forms a space producing an equivalent effect on suppressing leakage of airflow.

Regarding air conditioner 1 in the second embodiment, curved outer air path wall surface (first flow path wall) 15*c* has an arc shape (second arc shape) which is depressed along a circle of curvature centered at up-down rotation shaft 41*a*, and the arc shape (second arc shape) of curved outer air path wall surface 15*c* is located concentrically with the arc shape (first arc shape) of outer air path wall-side end 42*c*. Therefore, the space between curved outer air path wall surface 15*c* and outer air path wall-side end 42*c* can be kept constant. It is therefore possible to increase the range in which the space between outer air path wall 15*b* and outer air path wall-side end 42*c* is kept constant. Accordingly, leakage of airflow can be suppressed more effectively.

Third Embodiment

Next, referring to FIGS. 6 to 9, a third embodiment of the present invention is described. The third embodiment is similar to the above-described first or second embodiment except for the below-described features or limitations. FIGS. 6 to 9 are each a diagram similar to FIG. 4 relating to the first embodiment.

Figure 6:
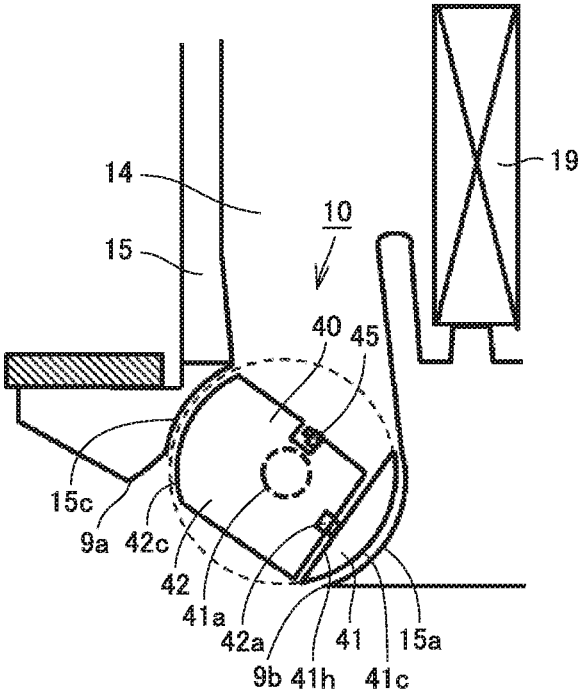
FIG. 6 is a schematic diagram showing a portion, which corresponds to the portion in FIG. 4, of an air conditioner in a third embodiment of the present invention.

Referring to FIG. 6, in the third embodiment, deflector 40 extends from up-down rotation shaft 41*a* toward inner air path wall (second flow path wall) 15*a*. Deflector 40 has an inner air path wall-side surface (second end) 41*c* facing inner air path wall (second flow path wall) 15*a*. Inner air path wall-side surface (second end) 41*c* has an arc shape (third arc shape).

Specifically, at least a part of up-down deflector 41 is in proximity to inner air path wall 15*a*, constantly keeping a predetermined distance to inner air path wall 15*a*. Inner air path wall-side surface 41*c* of up-down deflector 41 has a curved surface bulging toward inner air path wall 15*a* as seen from up-down rotation shaft 41*a*. This curved surface is a cylindrical surface centered at up-down rotation shaft 41*a*. Thus, regardless of the orientation of up-down deflector 41, at least a part of this curved surface is in proximity to inner air path wall 15*a*, constantly keeping a predetermined distance to inner air path wall 15*a*.

Inner air path wall 15*a* facing up-down deflector 41 is preferably a cylindrical surface concentric with the cylindrical surface of inner air path wall-side surface 41*c* of up-down deflector 41. An outlet air path-side surface 41*h* of up-down deflector 41 is a flat surface or a curved surface depressed toward the air path. As up-down deflector 41 is rotated in the up-down direction to the position at the closest proximity to the outer air path wall, air outlet 9 is entirely closed.

Figure 7:
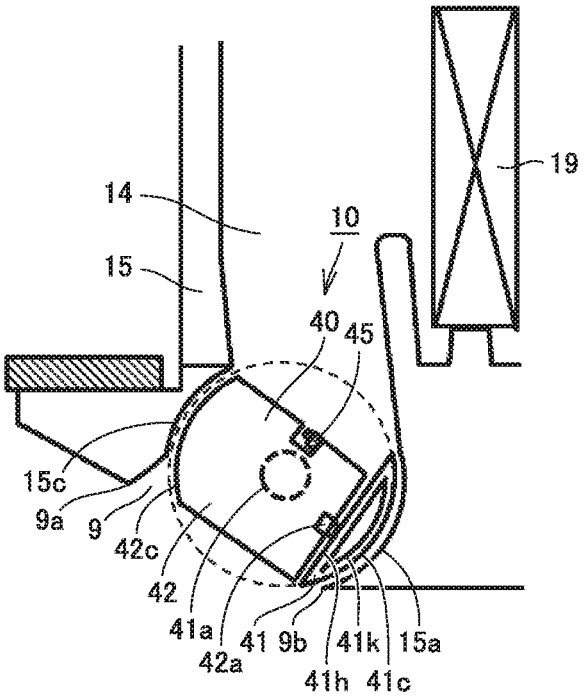
FIG. 7 is a schematic diagram showing a portion, which corresponds to the portion in FIG. 4, of an air conditioner in a first modification of the third embodiment of the present invention.

Referring next to FIG. 7, a first modification of the third embodiment is described. According to the first modification of the third embodiment, up-down deflector 41 may be formed of a follow member having a predetermined thickness. Specifically, up-down deflector 41 is formed of a hollow member having an outer wall 41*k* and an internal space enclosed by outer wall 41*k*.

Figure 8:
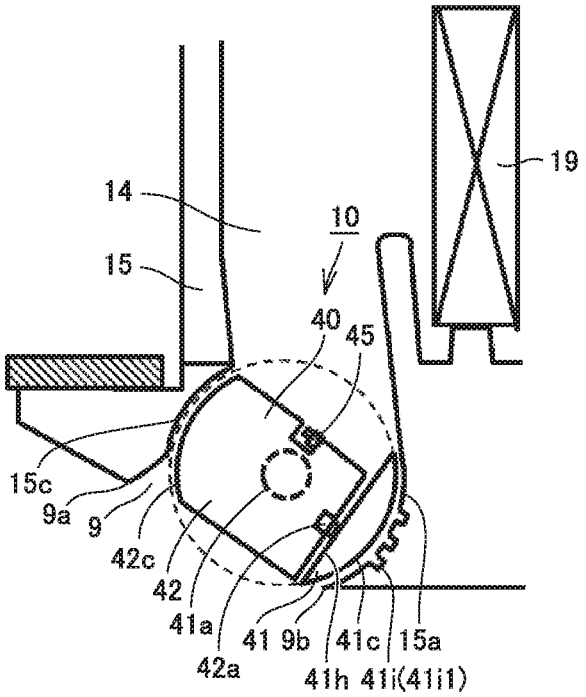
FIG. 8 is a schematic diagram showing a portion, which corresponds to the portion in FIG. 4, of an air conditioner in a second modification of the third embodiment of the present invention.
Figure 9:
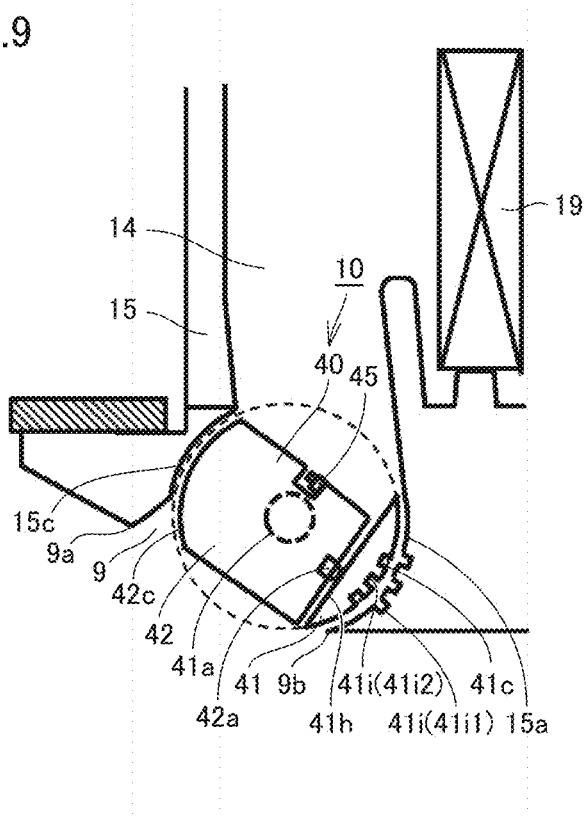
FIG. 9 is a schematic diagram showing a portion, which corresponds to the portion in FIG. 4, of an air conditioner in a third modification of the third embodiment of the present invention.

Referring to FIGS. 8 and 9, at least one of respective surfaces facing each other of up-down deflector 41 and inner air path wall 15*a* may have a groove 41*i* extending in the direction of up-down rotation shaft 41*a*. More than one groove 41*i* may be provided. Groove 41*i* can promote formation of turbulent by airflow passing in the space between up-down deflector 41 and inner air path wall 15*a*. Thus, the resistance can be increased to reduce airflow passing through this space.

As shown in FIG. 8, according to a second modification of the present embodiment, inner air path wall (second flow path wall) 15*a* has a groove (first groove) 41*i*1 depressed in the opposite direction to wind direction changing device 10.

As shown in FIG. 9, according to a third modification of the present embodiment, up-down deflector 41 of deflector 40 has a groove (second groove) 41*i*2 depressed in the opposite direction to inner air path wall (second flow path wall) 15*a*. Grooves 41*i* in both inner air path wall 15*a* and up-down deflector 41 can form a labyrinth structure to further promote formation of turbulence flow.

Regarding air conditioner 1 in the third embodiment, inner air path wall-side surface (second end) 41*c* facing inner air path wall (second flow path wall) 15*a* has an arc shape (third arc shape). Therefore, while deflector 40 is rotated about up-down rotation shaft 41*a*, the space between inner air path wall 15*a* and inner air path wall-side surface 41*c* can be kept constant. Accordingly, leakage of airflow from the space between inner air path wall 15*a* and inner air path wall-side surface 41*c* can be suppressed.

Therefore, most of the outgoing airflow passes between up-down deflector 41 and outer air path wall 15*b*. Namely, most of the outgoing airflow passes between left-right deflectors 42. It is thus possible to enhance the force exerted in the left-right direction on the air. Accordingly, the range across which air is distributed in the left-right direction can be increased. Therefore, uneven temperature in a space to be air-conditioned can be suppressed, and air can be moved so as not to impinge directly against a user. Further, because air outlet 9 can be entirely closed by up-down deflector 41 while operation is stopped, the appearance is improved.

Regarding air conditioner 1 in the first modification of the third embodiment, up-down deflector 41 is formed of a hollow member. Therefore, the front side and the rear side of up-down deflector 41 are thermally insulated by air in the internal space. Even when up-down deflector 41 is cooled by cold air during a cooling operation, the cold air is hindered from being transferred to the surface opposite to outlet air path 14. It is thus possible to suppress condensation resultant from contact with hot and moist indoor air.

Regarding air conditioner 1 in the second modification of the third embodiment, inner air path wall (second flow path wall) 15*a* has groove 41*i*1 (first groove). Therefore, it is possible to promote formation of turbulence by airflow passing in the space between up-down deflector 41 and inner air path wall 15*a*. Thus, the resistance can be increased to reduce airflow passing through the space between up-down deflector 41 and inner air path wall 15*a*.

Regarding air conditioner 1 in the third modification of the third embodiment, up-down deflector 41 has groove (second groove) 41*i*2 depressed in the opposite direction to inner air path wall (second flow path wall) 15*a*. Groove 41*i*2 can promote formation of turbulence by airflow passing in the space between up-down deflector 41 and inner air path wall 15*a*. Thus, the resistance can be increased to reduce airflow passing through the space between up-down deflector 41 and inner air path wall 15*a*. When condensation occurs to the surface of up-down deflector 41, water droplets are held in groove 41*i*2. It is therefore possible to prevent water droplets due to condensation from falling.

Fourth Embodiment

Figure 10:
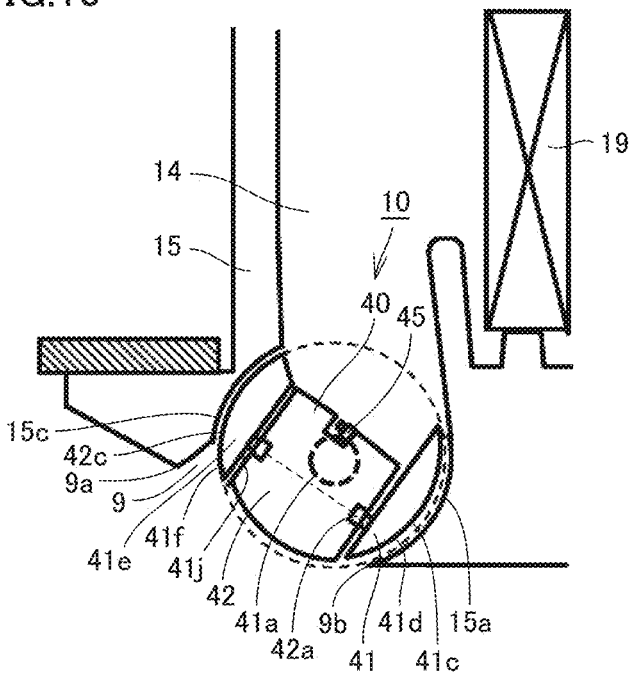
FIG. 10 is a schematic diagram showing a portion, which corresponds to the portion in FIG. 4, of an air conditioner in a fourth embodiment of the present invention.
Figure 11:
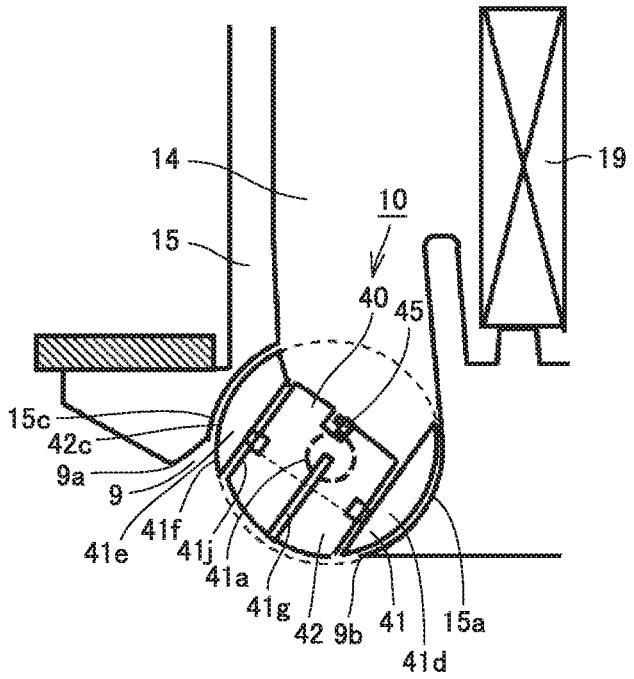
FIG. 11 is a schematic diagram showing a portion, which corresponds to the portion in FIG. 4, of an air conditioner in a modification of the fourth embodiment of the present invention.

Next, referring to FIGS. 10 and 11, a fourth embodiment of the present invention is described. The fourth embodiment is similar to the above-described first to third embodiments except for the below-described features or limitations. FIGS. 10 and 11 are each a diagram similar to FIG. 4 relating to the first embodiment.

Referring to FIG. 10, in the fourth embodiment, up-down deflector 41 includes a first up-down deflector 41*e* and a second up-down deflector 41*d*. Between first up-down deflector 41*e* and second up-down deflector 41*d*, left-right deflector 42 is sandwiched. First up-down deflector 41*e* and second up-down deflector 41*d* are disposed to face each other.

First up-down deflector 41*e* is disposed between left-right deflector 42 and outer air path wall (first flow path wall) 15*b*. Second up-down deflector 41*d* is disposed between left-right deflector 42 and inner air path wall (second flow path wall) 15*a*. First up-down deflector 41*e* has an outer air path wall-side end (first end) 42*c* located opposite to left-right deflector 42.

First up-down deflector 41*e* is shorter in the length in the lateral direction than second up-down deflector 41*d*. First up-down deflector 41*e* is fixed together with second up-down deflector 41*d* by deflector side plate 41*b* (see FIG. 3) and rotationally driven together with second up-down deflector 41*d*.

An outer air path wall-side surface 41*f* of first up-down deflector 41*e* has a curved surface bulging toward curved outer air path wall surface 15*c*. This curved surface is a cylindrical surface centered at up-down rotation shaft 41*a*. Regardless of the orientation of up-down deflector 41, at least a part of this curved surface is in proximity to curved outer air path wall surface 15*c*, constantly keeping a predetermined distance to curved outer air path wall surface 15*c*. Curved outer air path wall surface 15*c* facing first up-down deflector 41*e* is preferably a cylindrical surface concentric with the cylindrical surface, on the outer air path wall side, of first up-down deflector 41*e*. An outlet air path-side surface 41*j* of first up-down deflector 41*e* is a flat surface or a curved surface bulging toward the outlet air path.

The upstream-to-downstream length (length in the lateral direction) of first up-down deflector 41*e* is shorter than the upstream-to-downstream length of second up-down deflector 41*d*. This can prevent reduction of the air path due to protrusion of first up-down deflector 41*e* into the outlet air path when the up-down direction in which air is to be discharged is set to the upward direction. Up-down rotation shaft 41*a* is disposed at the center of the cylindrical surface of second up-down deflector 41*d* and the center of the cylindrical surface of first up-down deflector 41*e*.

Referring to FIG. 11, according to a modification of the present embodiment, an auxiliary up-down deflector 41*g* is disposed between first up-down deflector 41*e* and second up-down deflector 41*d*. Auxiliary up-down deflector 41*g* is disposed in parallel with first up-down deflector 41*e* or second up-down deflector 41*d*, and fixed to deflector side plate 41*b* (see FIG. 3). The distance from the downstream end of auxiliary up-down deflector 41*g* to up-down rotation shaft 41*a* is preferably equal to or less than radius Ro of the cylindrical surface of second up-down deflector 41*d* that is in contact with the outer air path wall. The distance equal to or less than radius Ro makes it possible to prevent contact between auxiliary up-down deflector 41*g* and the outer air path wall while the plate is driven up and down, and to allow second up-down deflector 41*d* to be moved to and stay at the outer air path wall while stopped, to thereby leave no space in air outlet 9, which improves the quality of design.

Left-right deflector 42 is disposed between first up-down deflector 41*e* and second up-down deflector 41*d*, and fixed at a left-right rotation shaft which enables left-right deflector 42 to rotate in the left-right direction. First up-down deflector 41*e* and second up-down deflector 41*d* are fixed by deflector side plate 41*b* (see FIG. 3). Regardless of the angle of up-down deflector 41, a certain distance is constantly kept between first and second up-down deflectors 41*e* and 41*d*. It is therefore possible to have a large distance between respective ends, facing each other, of first up-down deflector 41*e* and left-right deflector 42, and the space can be partitioned all the time by left-right deflectors 42.

For the wind direction set to the up-down direction that does not cause airflow discharged from the air outlet to reach the ceiling, preferably the angle formed between the ceiling surface and a tangent at the downstream end of outlet air path-side surface 41*j* of first up-down deflector 41*e* is 30° or more. Accordingly, no discharged airflow reaches the ceiling, which can prevent dirt on the ceiling surface due to smudging.

Regarding the fourth embodiment, air passes by left-right deflector 42 sandwiched between first up-down deflector 41*e* and second up-down deflector 41*d*. It is therefore possible to improve the force exerted in the left-right direction on the air, expand the range across which airflow is distributed in the left-right direction, and alleviate uneven temperature in a space to be air-conditioned.

Fifth Embodiment

Figure 12:
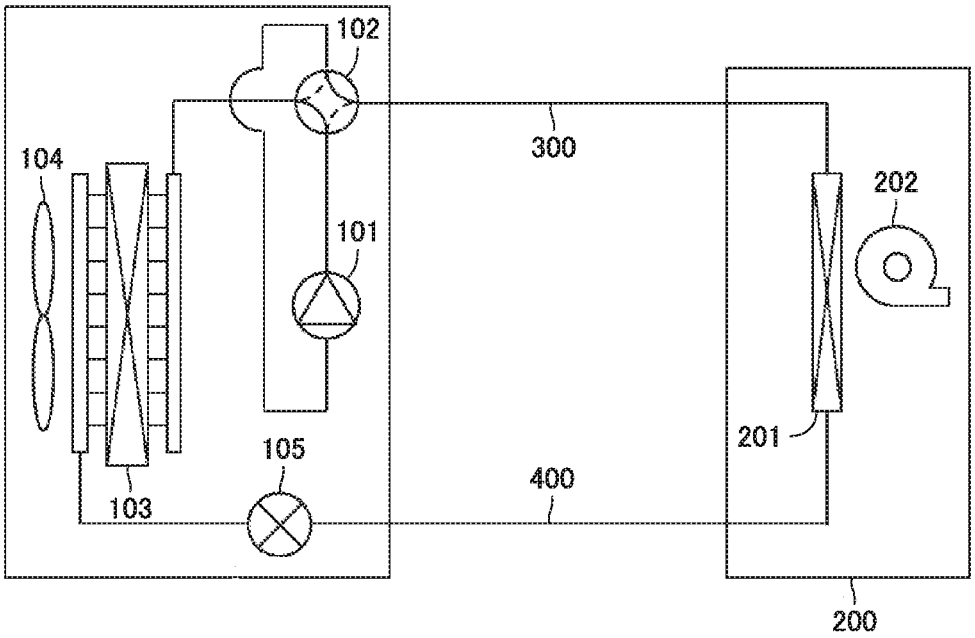
FIG. 12 is a schematic diagram showing a configuration of a refrigerant circuit of an air conditioner in a fifth embodiment of the present invention.

FIG. 12 is a configuration diagram of an air conditioning apparatus in a fifth embodiment of the present invention. According to the fifth embodiment, a description is given of an air conditioning apparatus equipped with above-described air conditioner 1 (indoor unit 200). The air conditioning apparatus includes an outdoor unit 100 and an indoor unit 200. The indoor and outdoor units are connected together by a refrigerant pipe to form a refrigerant circuit in which refrigerant is to be circulated. The refrigerant pipe includes a gas pipe 300 in which refrigerant in the gaseous state (gas refrigerant) flows, and a liquid pipe 400 in which refrigerant in the liquid state (liquid refrigerant, or may be gas-liquid two-phase refrigerant) flows.

Outdoor unit 100 in the present embodiment includes a compressor 101, a four-way valve 102, an outdoor heat exchanger 103, an outdoor blower 104, and a throttle device (expansion valve) 105.

Compressor 101 sucks and compresses refrigerant and discharges the resultant refrigerant. Compressor 101 has an inverter or the like for changing the operating frequency as required to thereby enable fine adjustment of the capacity (the amount of refrigerant discharged per unit time) of compressor 101. Four-way valve 102 switches the direction of flow of refrigerant depending on whether the operation is cooling operation or heating operation, based on a command from a control device (not shown).

Outdoor heat exchanger 103 exchanges heat between refrigerant and air (outdoor air). For example, during a heating operation, outdoor heat exchanger 103 functions as an evaporator to cause heat exchange between air and low-pressure refrigerant flowing from liquid pipe 400, and thereby evaporate and vaporize the refrigerant. During a cooling operation, outdoor heat exchanger 103 functions as a condenser to cause heat exchange between air and refrigerant flowing from four-way valve 102 and compressed by compressor 101, and thereby condense and liquefy the refrigerant. For efficient heat exchange between refrigerant and air, outdoor heat exchanger 103 is equipped with outdoor blower 104 having a fan or the like. For outdoor blower 104 as well, an inverter may change the operating frequency of the fan to make fine adjustment of the rotational speed of the fan. Throttle device 105 is provided to change the degree of opening and thereby adjust pressure for example of refrigerant.

Indoor unit 200 includes a load heat exchanger 201 and a load blower 202. Load heat exchanger 201 exchanges heat between refrigerant and air. For example, during a heating operation, load heat exchanger 201 functions as a condenser to cause heat exchange between air and refrigerant flowing from gas pipe 300 and thereby condense and liquefy the refrigerant (or convert the refrigerant into two phases of gas and liquid), and allow the refrigerant to flow toward liquid pipe 400. During a cooling operation, load heat exchanger 201 functions as an evaporator to exchange heat between air and low-pressure refrigerant generated by throttle device 105 for example, so that heat is transferred from air to the refrigerant to cause the refrigerant to be evaporated and vaporized, and then flow to gas pipe 300. Indoor unit 200 is also equipped with load blower 202 for adjusting flow of the air with which heat is exchanged. The operating speed of load blower 202 is determined by setting made by a user, for example.

As seen from the above, for the air conditioning apparatus in the fifth embodiment, air conditioner 1 described above in connection with the first to fourth embodiments may be used as outdoor unit 100, and thus similar effects to those of the first to fourth embodiments can be produced.

In the foregoing, details of the present invention are described specifically with reference to the preferred embodiments. It is obvious, however, to those skilled to the art that a variety of variations may be incorporated based on the basic technical idea and teaching of the present invention.

It should be construed that embodiments disclosed herein are given by way of illustration in all respects, not by way of limitation. It is intended that the scope of the present invention is defined by claims, not by the description above, and encompasses all modifications and variations equivalent in meaning and scope to the claims.

The invention claimed is:

1. An air conditioner comprising:

a casing having an air inlet, an air outlet having a first side and a second side extending along the first side, the second side being located closer to the air inlet than the first side, a first flow path wall connected to the first side of the air outlet, and a second flow path wall connected to the second side of the air outlet; and a wind direction changing device disposed between the first flow path wall and the second flow path wall of the casing, the wind direction changing device having a shaft extending in a direction along the second side, and a deflector connected to the shaft and configured to rotate about the shaft, the deflector extending from the shaft toward the first flow path wall, and the deflector having a first end which faces the first flow path wall and extends linearly along the first flow path wall, and a radially outer periphery of the first end as seen in a cross-sectional view has a first arc shape, the deflector comprises an up-down deflector configured to distribute airflow from the air outlet in an up-down direction; and a left-right deflector disposed on the up-down deflector and configured to distribute airflow from the air outlet in a left-right direction, the first end and the up-down deflector are disposed on opposite sides of the deflector, and a center of the shaft coincides with a center of curvature of the first arc shape, and points along the radially outer periphery of the first arc shape as seen in the cross-sectional view are equidistant from the center of the shaft, the air inlet and the air outlet being disposed in a lower portion of the casing.

2. The air conditioner according to claim 1, wherein the up-down deflector is formed of a hollow member having an outer wall and an internal space enclosed by the outer wall.

3. The air conditioner according to claim 1, wherein the first flow path wall has a second arc shape depressed along a circle of curvature centered at the shaft, and the second arc shape is concentric with the first arc shape.

4. The air conditioner according to claim 1, wherein the deflector extends from the shaft toward the second flow path wall, and the deflector has a second end facing the second flow path wall and having a third arc shape.

5. The air conditioner according to claim 1, wherein the second flow path wall has a first groove depressed in an opposite direction to the wind direction changing device.

6. The air conditioner according to claim 1, wherein the deflector has a second groove depressed in an opposite direction to the second flow path wall.

* * * * *